US011674523B1

(12) United States Patent
Kesterson et al.

(10) Patent No.: US 11,674,523 B1
(45) Date of Patent: Jun. 13, 2023

(54) DYNAMICALLY CONTROLLED COOLING DEVICE

(71) Applicants: Kelly Kesterson, Fresno, TX (US); John Scott Hinklin, Houston, TX (US)

(72) Inventors: Kelly Kesterson, Fresno, TX (US); John Scott Hinklin, Houston, TX (US)

( * ) Notice: Subject to any disclaimer, the term of this patent is extended or adjusted under 35 U.S.C. 154(b) by 0 days.

(21) Appl. No.: 17/743,063

(22) Filed: May 12, 2022

(51) Int. Cl.
*F04D 25/10* (2006.01)
*F04D 29/28* (2006.01)
*F04D 17/16* (2006.01)

(52) U.S. Cl.
CPC ..... *F04D 25/105* (2013.01); *F04D 17/16* (2013.01); *F04D 29/283* (2013.01); *F04D 29/287* (2013.01)

(58) Field of Classification Search
CPC ..... F04D 25/10; F04D 25/105; F04D 29/287
See application file for complete search history.

(56) References Cited

U.S. PATENT DOCUMENTS

| | | | |
|---|---|---|---|
| 10,323,854 B2 | 6/2019 | Byers | |
| 10,597,155 B2 | 3/2020 | Karabed | |
| 10,690,372 B2 | 6/2020 | Arens | |
| 10,989,209 B2 | 4/2021 | Xing | |
| 2017/0248970 A1 | 8/2017 | Karabed | |
| 2019/0003480 A1 | 1/2019 | Hall | |
| 2022/0136515 A1* | 5/2022 | Oelke | F04D 25/105 700/276 |
| 2022/0235783 A1* | 7/2022 | Chengalva | F04D 25/10 |

FOREIGN PATENT DOCUMENTS

| | | |
|---|---|---|
| CN | 104728137 | * 12/2013 |
| KR | 20140066571 | * 11/2012 |
| WO | WO2015095753 | 6/2015 |

OTHER PUBLICATIONS

ACI Sensors "Tech Tips Episode #2 • Calculating Air Flow Volume with Pressure Transmitters" YouTube, Mar. 6, 2019, https://www.youtube.com/watch?v=eTFQWN8qdZ4 (Year: 2019).*

* cited by examiner

*Primary Examiner* — Woody A Lee, Jr.
*Assistant Examiner* — Brian O Peters

(57) ABSTRACT

A dynamically controlled cooling device for targeted cooling of a moving or stationary user includes a fan, which is rotationally mounted to a base, and a targeting device, which is in possession of the user. A first actuator is attached to the base and is operationally engaged to the fan to selectively rotate the fan. A control module is operationally engaged to the first actuator and the fan. The control module comprises a first receiver, which is Global Positioning System (GPS) enabled, and a second receiver. The targeting device comprises a third receiver, which is GPS enabled, and a transmitter. The first receiver and the third receiver receive coordinates of the fan and the user, respectively. The transmitter relays the coordinates of the user to the control module, whereupon the control module to actuates the fan and the first actuator to direct a stream of air onto the user.

13 Claims, 5 Drawing Sheets

DYNAMICALLY CONTROLLED COOLING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cooling devices and more particularly pertains to a new cooling device for targeted cooling of a moving or stationary user. The present invention discloses a cooling device comprising a fan and a tracker, the latter being positioned on a user. The Global Positioning System (GPS) enables the coordinates of the fan and the user to be used to direct a stream of air onto the user.

(2) Description of Related Art Including Information Disclosed Under 37 CFR 1.97 and 1.98

The prior art relates to cooling devices. Prior art cooling devices may comprise fans that are directed by thermographic imaging, movable fans that track users using cameras or ultrasonic transmitters and receivers, and tiltable fans, which may be movable along tracks. Related prior art comprises drones that are programmed to cast their shadows upon users or to direct air from their propellers onto users. What is lacking in the prior art is a cooling device comprising a fan, which is rotationally mounted to a base, and a targeting device, which is in possession of the user. Actuators selectively rotate and tilt the fan. Global Positioning System (GPS) enabled receivers positioned near the fan and in the tracking device enable the coordinates of the fan and the user to be used to direct a stream of air onto the user.

BRIEF SUMMARY OF THE INVENTION

An embodiment of the disclosure meets the needs presented above by generally comprising a fan, which is rotationally mounted to an upper face of a base, and a targeting device, which is in possession of a user. A first actuator is attached to the base and is operationally engaged to the fan to selectively rotate the fan. A control module is attached to the base and is operationally engaged to the first actuator and the fan. The control module comprises a first receiver, which is Global Positioning System (GPS) enabled, and a second receiver. The targeting device comprises a third receiver, which is GPS enabled, and a transmitter. The first receiver and the third receiver are enabled to receive coordinates of the fan and the user, respectively. The transmitter is enabled to relay the coordinates of the user to the control module, via the second receiver, enabling the control module to selectively actuate the fan and the first actuator to direct a stream of air onto the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
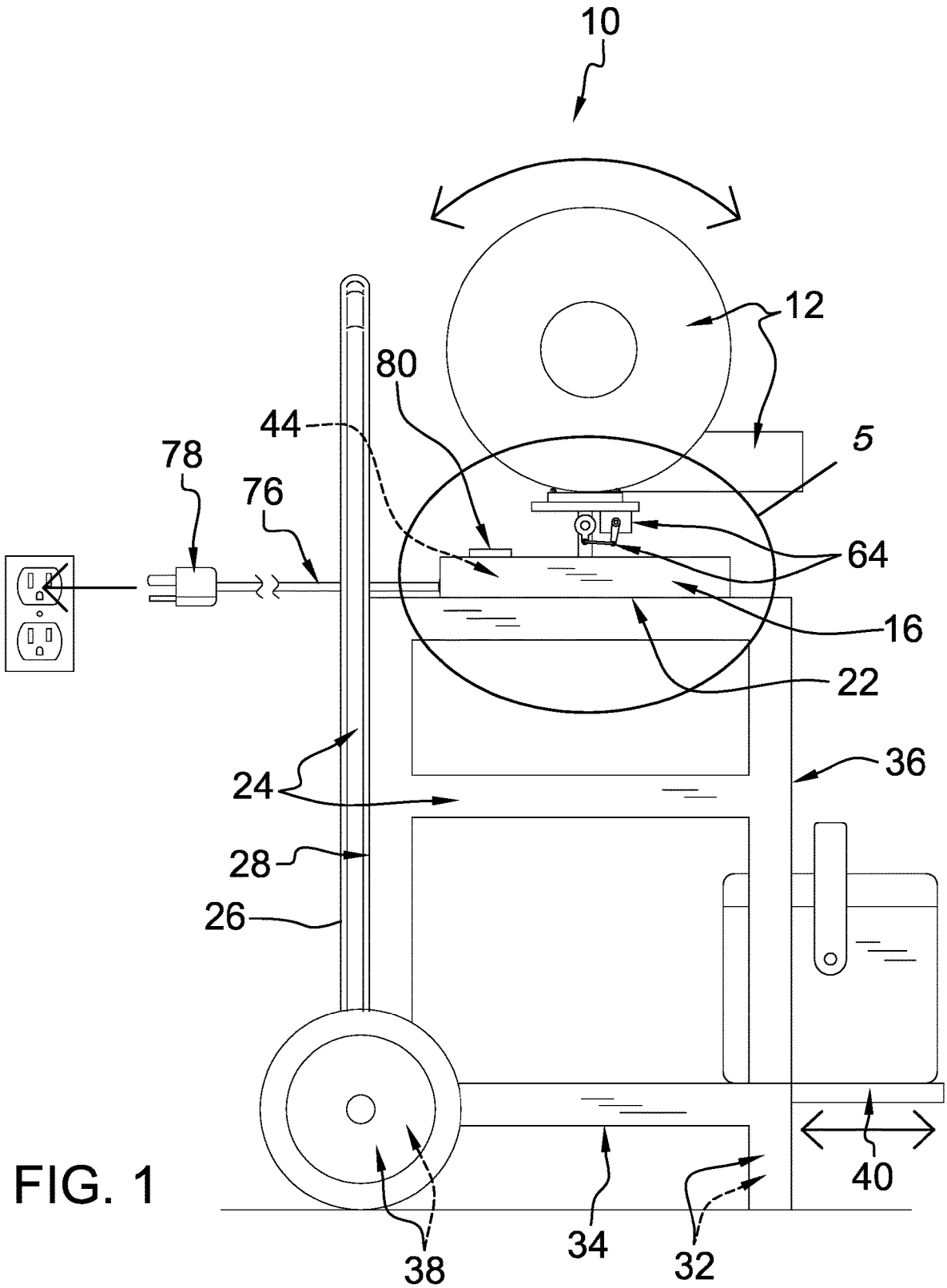
FIG. 1 is a side view of a dynamically controlled cooling device according to an embodiment of the disclosure.
Figure 2:
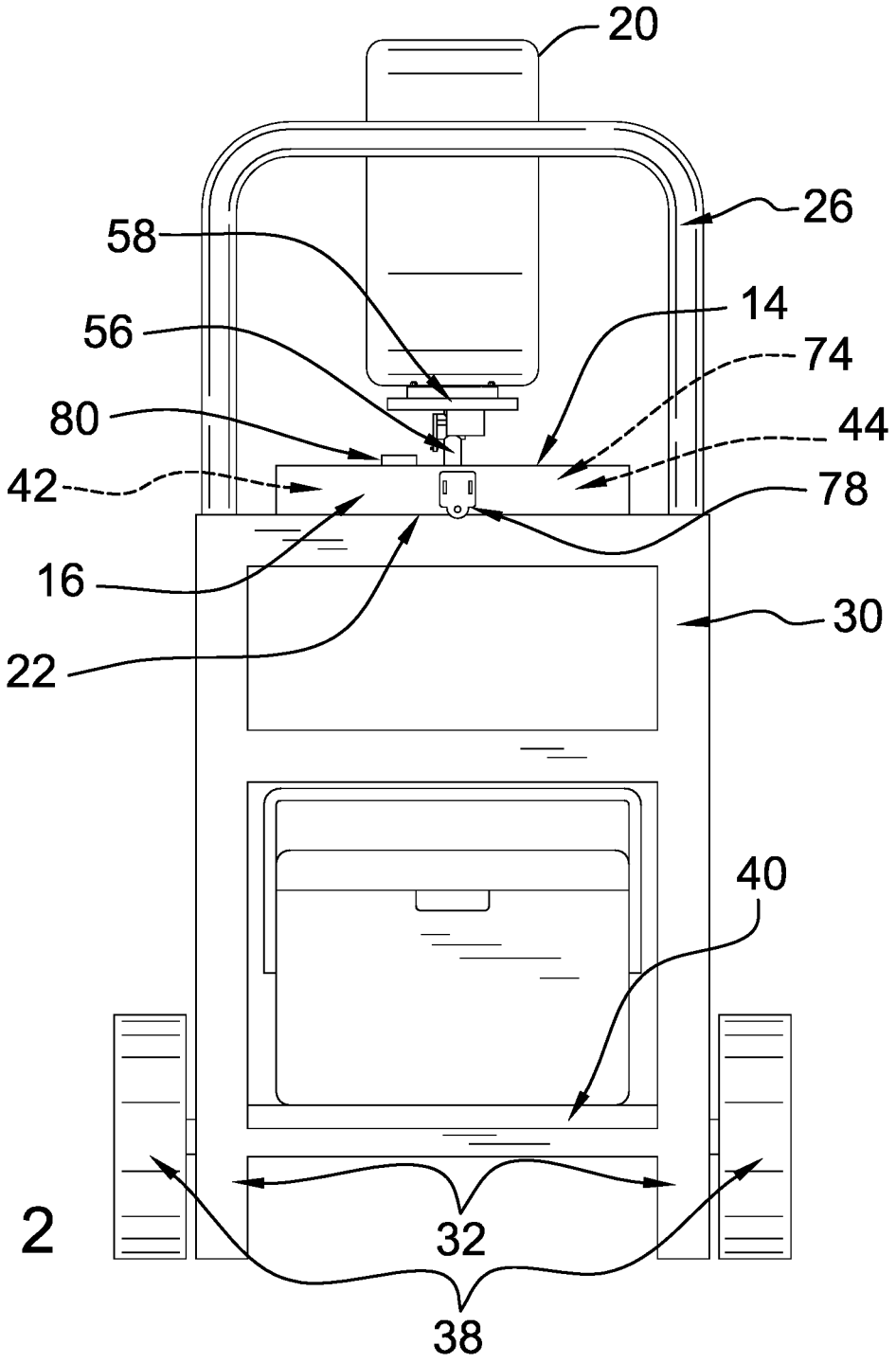
FIG. 2 is a rear view of an embodiment of the disclosure.

With reference now to the drawings, and in particular to FIGS. 1 through 5 thereof, a new cooling device embodying the principles and concepts of an embodiment of the disclosure and generally designated by the reference numeral 10 will be described.

Figure 3:
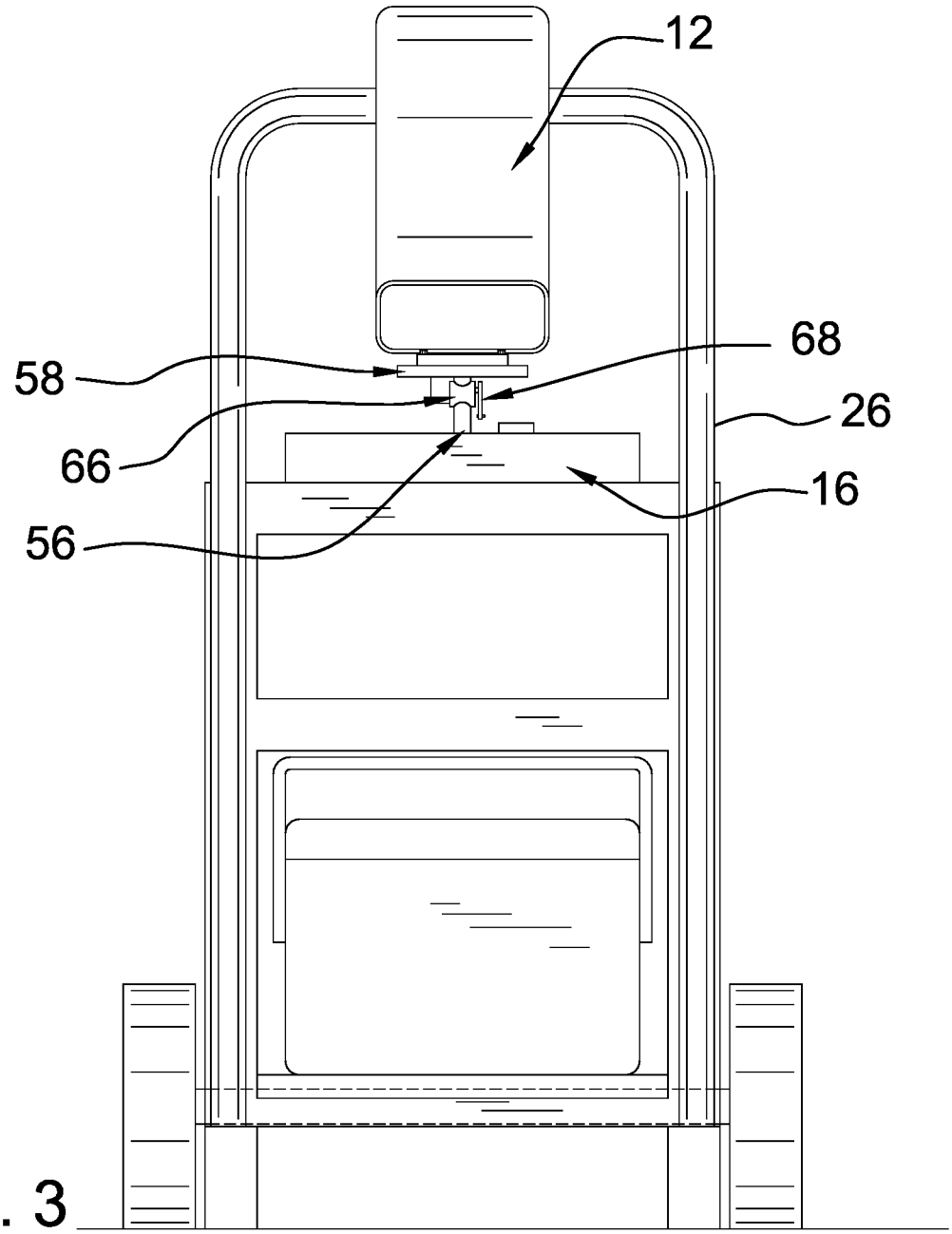
FIG. 3 is a front view of an embodiment of the disclosure.
Figure 4:
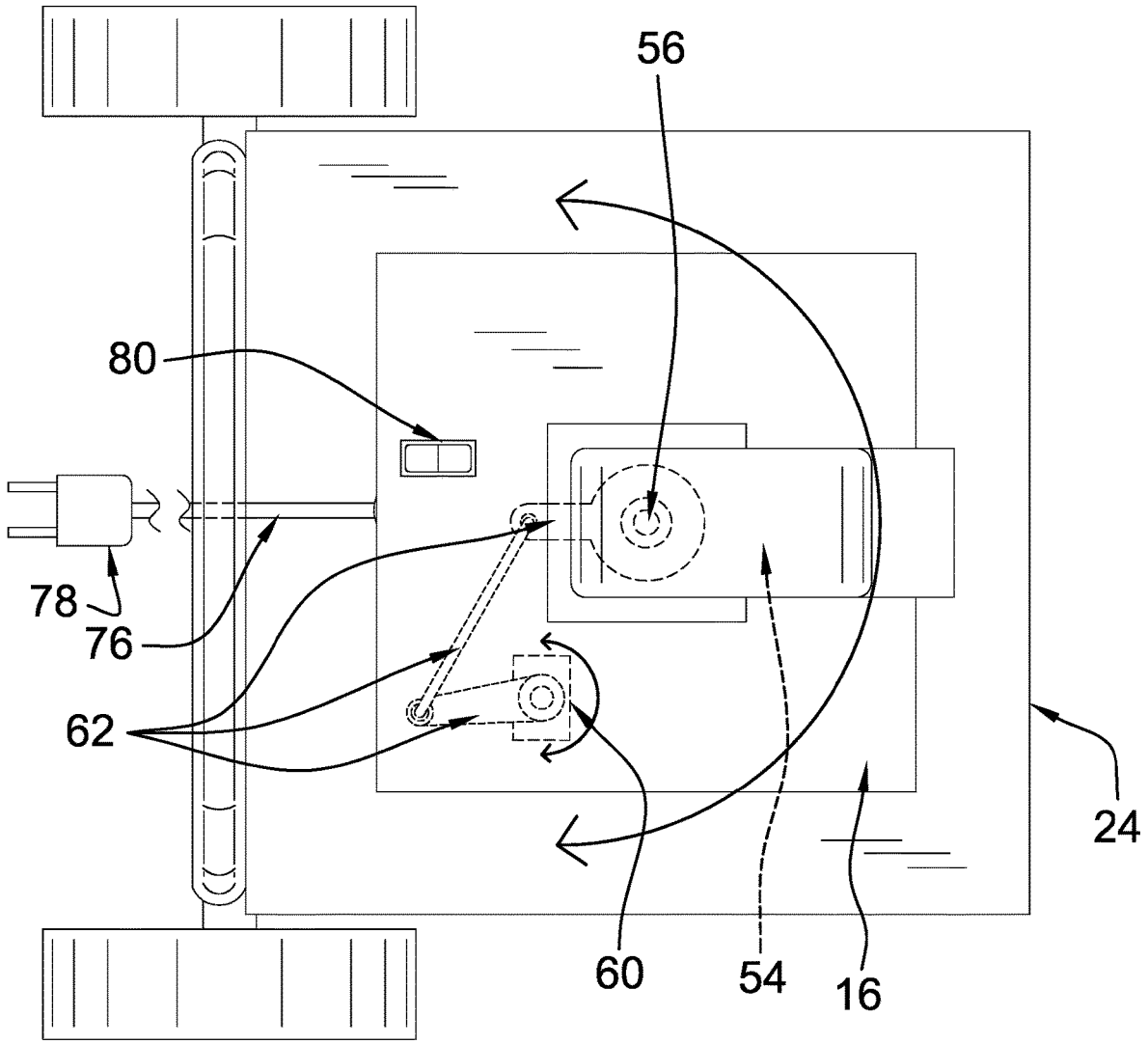
FIG. 4 is a top view of an embodiment of the disclosure.

As best illustrated in FIGS. 1 through 5, the dynamically controlled cooling device 10 generally comprises a fan 12, which is rotationally mounted to an upper face 14 of a base 16, and a targeting device 18, which is in possession of a user. The fan 12 also is tiltable relative to the base 16 and may comprise a squirrel cage blower 20, as shown in FIG. 3, a circular fan, a box fan, or the like.

As shown in FIG. 1, the base 16 is mounted to a top 22 of a pedestal 24 so that the base 16 is elevated above a surface upon which the pedestal 24 is positioned. The pedestal 24 may comprise a dolly 26, which is attached to a rear 28 of a frame 30. A pair of legs 32 is attached to and extends from a lower end 34, and proximate to a front 36, of the frame 30 so that the top 22 of the pedestal 24 is substantially parallel to a surface upon which a pair of wheels 38 of the dolly 26 and the pair of legs 32 are positioned. As shown in FIG. 1, a shelf 40 is slidably attached to the frame 30 proximate to the lower end 34. The shelf 40 is selectively extensible from the front 36 of the frame 30 and can be used for stowing an item, such as a cooler.

A first actuator 42 is attached to the base 16 and is operationally engaged to the fan 12 to selectively rotate the fan 12. A control module 44 is attached to the base 16 and is operationally engaged to the first actuator 42 and the fan 12. The control module 44 comprises a first receiver 46, which is Global Positioning System (GPS) enabled, and a second receiver 48.

The targeting device 18 comprises a third receiver 50, which is GPS enabled, and a transmitter 52. The first receiver 46 and the third receiver 50 are enabled to receive coordinates of the fan 12 and the user, respectively. The transmitter 52 is enabled to relay the coordinates of the user to the control module 44, via the second receiver 48, enabling the control module 44 to selectively actuate the fan 12 and the first actuator 42 to direct a stream of air onto the user.

The control module 44 is positioned in a cavity 54, which is positioned in the base 16. A shaft 56 extends from the cavity 54 through the upper face 14 of the base 16. A plate 58 is hingedly engaged to the shaft 56 distal from the base 16, with the fan 12 being attached to the plate 58.

The first actuator 42 may comprise a first servomotor 60, which is attached to the base 16 and which is positioned in the cavity 54. A first linkage 62 is attached to and extends between the first servomotor 60 and the shaft 56 so that actuation of the first servomotor 60 rotates the fan 12 concurrently with the shaft 56. The first actuator 42 may comprise other actuating means, such as, but not limited to, actuators in combination with belts, chains, pinions, and the like.

A second actuator 64 attached to the base 16 and is operationally engaged to the fan 12 to selectively tilt the fan 12. The second actuator 64 comprises a second servomotor 66, which is attached to the shaft 56 and is positioned externally to the base 16. A second linkage 68 is attached to and extends between the second servomotor 66 and the plate 58 so that actuation of the second servomotor 66 hinges the fan 12 relative to the shaft 56. The second actuator 64 may comprise other actuating means, such as, but not limited to, actuators in combination with belts, chains, pinions, and the like.

The control module 44 also comprises a microprocessor 70 and a motor controller 72. The microprocessor 70 is operationally engaged to the first receiver 46 and the second receiver 48. The motor controller 72 is operationally engaged to the microprocessor 70, the first servomotor 60, and the second servomotor 66.

A power module 74 is operationally engaged to the control module 44. The power module 74 may comprise a power cord 76, though the present invention also anticipates the dynamically controlled cooling device 10 being battery powered. A plug 78 of the power cord 76 is configured to connect the control module 44 to a source of electrical current. A switch 80 is attached to the base 16 and is operationally engaged to the control module 44 and the power module 74. The switch 80 is configured to be switched to selectively power the control module 44.

Figure 5:
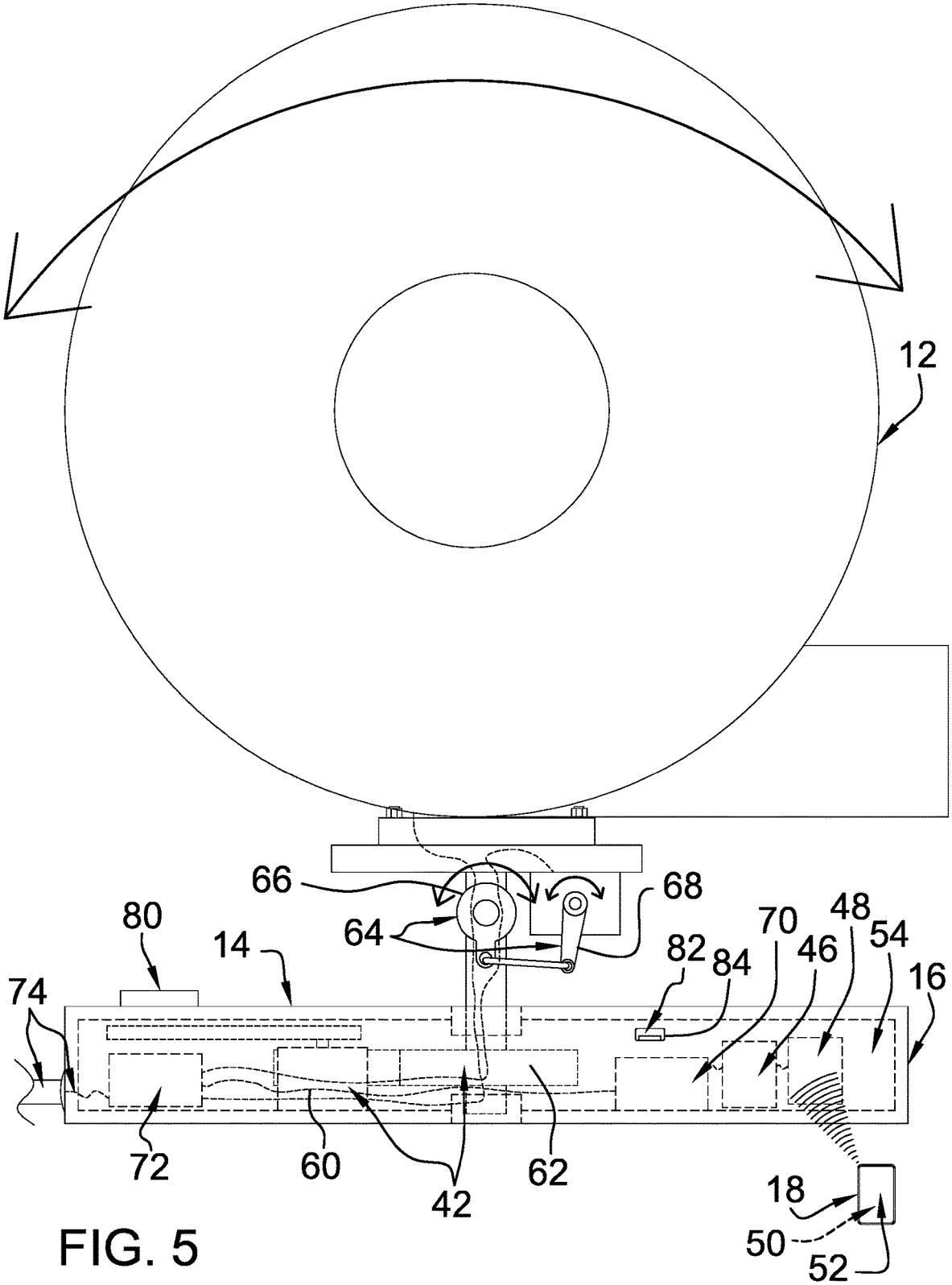
FIG. 5 is a detail view of an embodiment of the disclosure.

A socket 82 is attached to the base 16 and is operationally engaged to the microprocessor 70. The socket 82 is configured for insertion of a plug of a power cable (not shown) to power an electronic device, such as a smartphone (for charging), a music player, or the like. The socket 82 may comprise a Universal Serial Bus port 84, as shown in FIG. 5, a barrel socket, or the like.

In use, the pedestal 24 is wheeled to a desired location and the plug 78 of the power cord 76 is plugged into an outlet. The switch 80 is switched to provide power to the control module 44. With the targeting device 18 in possession of the user, and the user's position relative to the fan 12 determined by the microprocessor 70 using the coordinates of the fan 12 and the user, the first actuator 42 and the second actuator 64 are selectively actuated by the microprocessor 70 to rotate and to tilt the fan 12 so that a stream of air from the fan 12 is directed onto the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded.

A reference to an element by the indefinite article "a" does not exclude the possibility that more than one of the element is present, unless the context clearly requires that there be only one of the elements.

We claim:

1. A dynamically controlled cooling device comprising:

a base;

a fan rotationally mounted to an upper face of the base;

a first actuator attached to the base and being operationally engaged to the fan for selectively rotating the fan;

a control module attached to the base and operationally engaged to the first actuator and the fan, the control module comprising a first receiver and a second receiver, the first receiver being Global Positioning System (GPS) enabled; and a targeting device in possession of a user, the targeting device comprising a third receiver and a transmitter, the third receiver being GPS enabled, such that the first receiver and the third receiver are enabled for receiving coordinates of the fan and the user, respectively, and such that the transmitter is enabled to relay the coordinates of the user to the control module via the second receiver, enabling the control module for selectively actuating the fan and the first actuator for directing a stream of air onto the user.

2. The dynamically controlled cooling device of claim 1, wherein the base is mounted to a top of a pedestal, such that the base is elevated above a surface upon which the pedestal is positioned.

3. The dynamically controlled cooling device of claim 2, wherein the pedestal comprises:

a frame;

a dolly attached to a rear of the frame; and a pair of legs attached to and extending from a lower end and proximate to a front of the frame, such that the top of the pedestal is substantially parallel to a surface upon which a pair of wheels of the dolly and the pair of legs are positioned.

4. The dynamically controlled cooling device of claim 3, further including a shelf slidably attached to the frame proximate to the lower end, such that the shelf is selectively extensible from the front of the frame.

5. The dynamically controlled cooling device of claim 1, wherein the fan comprises a squirrel cage blower.

6. The dynamically controlled cooling device of claim 1, wherein the fan is tiltable relative to the base.

7. The dynamically controlled cooling device of claim 1, further including:

a cavity positioned in the base, the control module being positioned in the cavity;

a shaft extending from the cavity through the upper face of the base;

a plate hingedly engaged to the shaft distal from the base, the fan being attached to the plate;

the first actuator comprising:

a first servomotor attached to the base and positioned in the cavity, and a first linkage attached to and extending between the first servomotor and the shaft, such that actuation of the first servomotor rotates the fan concurrently with the shaft;

the control module comprising:

a microprocessor operationally engaged to the first receiver and the second receiver, and a motor controller operationally engaged to the microprocessor and the first servomotor;

a power module operationally engaged to the control module; and a switch attached to the base and operationally engaged to the control module and the power module, wherein the switch is configured for being switched for selectively powering the control module.

8. The dynamically controlled cooling device of claim 7, wherein the power module comprises a power cord, wherein a plug of the power cord is configured for connecting the control module to a source of electrical current.

9. The dynamically controlled cooling device of claim 7, further including a socket attached to the base and operationally engaged to the microprocessor, wherein the socket is configured for insertion of a plug of a power cable for powering an electronic device.

10. The dynamically controlled cooling device of claim 9, wherein the socket comprises a Universal Serial Bus port.

11. The dynamically controlled cooling device of claim 7, further including a second actuator attached to the base and being operationally engaged to the fan for selectively tilting the fan.

12. The dynamically controlled cooling device of claim 11, wherein the second actuator comprises:

a second servomotor attached to the shaft and positioned externally to the base, the motor controller being operationally engaged to the second servomotor; and a second linkage attached to and extending between the second servomotor and the plate, such that actuation of the second servomotor hinges the fan relative to the shaft.

13. A dynamically controlled cooling device comprising:

a base, the base being mounted to a top of a pedestal, such that the base is elevated above a surface upon which the pedestal is positioned, the pedestal comprising:

a frame, a dolly attached to a rear of the frame, a pair of legs attached to and extending from a lower end and proximate to a front of the frame, such that the top of the pedestal is substantially parallel to a surface upon which a pair of wheels of the dolly and the pair of legs are positioned, and a shelf slidably attached to the frame proximate to the lower end, such that the shelf is selectively extensible from the front of the frame;

a cavity positioned in the base;

a fan rotationally mounted to an upper face of the base, the fan being tiltable relative to the base, the fan comprising a squirrel cage blower;

a shaft extending from the cavity through the upper face of the base;

a plate hingedly engaged to the shaft distal from the base, the fan being attached to the plate;

a first actuator attached to the base and being operationally engaged to the fan for selectively rotating the fan, the first actuator comprising:

a first servomotor attached to the base and positioned in the cavity, and a first linkage attached to and extending between the first servomotor and the shaft, such that actuation of the first servomotor rotates the fan concurrently with the shaft;

a control module attached to the base and operationally engaged to the first actuator and the fan, the control module comprising a first receiver and a second receiver, the first receiver being Global Positioning System (GPS) enabled, the control module being positioned in the cavity, the control module comprising:

a microprocessor operationally engaged to the first receiver and the second receiver, and a motor controller operationally engaged to the microprocessor, the first servomotor, and the second servomotor;

a power module operationally engaged to the control module, the power module comprising a power cord, wherein a plug of the power cord is configured for connecting the control module to a source of electrical current;

a switch attached to the base and operationally engaged to the control module and the power module, wherein the switch is configured for being switched for selectively powering the control module;

a socket attached to the base and operationally engaged to the microprocessor, wherein the socket is configured for insertion of a plug of a power cable for powering an electronic device, the socket comprising a Universal Serial Bus port;

a second actuator attached to the base and being operationally engaged to the fan for selectively tilting the fan, the second actuator comprising:

a second servomotor attached to the shaft and positioned externally to the base, and a second linkage attached to and extending between the second servomotor and the plate, such that actuation of the second servomotor hinges the fan relative to the shaft; and a targeting device in possession of a user, the targeting device comprising a third receiver and a transmitter, the third receiver being GPS enabled, such that the first receiver and the third receiver are enabled for receiving coordinates of the fan and the user, respectively, and such that the transmitter is enabled to relay the coordinates of the user to the control module via the second receiver, enabling the control module for selectively actuating the fan and the first actuator for directing a stream of air onto the user.

* * * * *